US005893283A

United States Patent [19]

Evans et al.

[11] Patent Number: 5,893,283

[45] Date of Patent: Apr. 13, 1999

[54] SOLENOID CONTROLLED BOLT CONTROL FOR AN ELECTRONIC LOCK

[75] Inventors: Walter R. Evans; Kenneth H. Mimlitch, both of Lexington; Larry J. Rice, Nicholasville, all of Ky.

[73] Assignee: Mas-Hamilton Group, Lexington, Ky., KY

[21] Appl. No.: 08/852,854

[22] Filed: May 7, 1997

[51] Int. Cl.[6] ..... E05B 49/02

[52] U.S. Cl. ..... 70/303 A; 70/278; 70/333 R

[58] Field of Search ..... 70/303 A, 303 R, 70/333 R, 277–279

[56] References Cited

U.S. PATENT DOCUMENTS

| | | | |
|---|---|---|---|
| 2,575,674 | 11/1951 | Miller | 70/303 A X |
| 2,658,374 | 11/1953 | Batrens | 70/303 A X |
| 4,745,784 | 5/1988 | Gartner | 70/277 |
| 4,831,851 | 5/1989 | Larson | 70/303 A |
| 4,910,981 | 3/1990 | Gartner | 70/303 A X |
| 5,307,656 | 5/1994 | Gartner et al. | 70/277 |
| 5,542,272 | 8/1996 | Heinemann | 70/303 A X |
| 5,592,838 | 1/1997 | Clark et al. | 70/303 A |
| 5,632,169 | 5/1997 | Clark et al. | 70/278 |
| 5,632,170 | 5/1997 | Evans | 70/303 A |
| 5,653,135 | 8/1997 | Miller et al. | 70/303 A |
| 5,715,716 | 2/1998 | Miller et al. | 70/303 A |
| 5,720,194 | 2/1998 | Miller et al. | 70/303 A |

FOREIGN PATENT DOCUMENTS

| | | | |
|---|---|---|---|
| 815654 | 7/1959 | United Kingdom | 70/303 A |

*Primary Examiner*—Suzanne Dino Barrett

*Attorney, Agent, or Firm*—Frost & Jacobs LLP; Laurence R. Letson

[57] ABSTRACT

An electronic combination lock of the self-powered type, wherein the electrical energy for operation of the lock is developed within the lock itself, has a solenoid which magnetically seals in the activated position, thus preserving the "open" condition of the lock until such time as the operator may withdraw the bolt. Significantly, there is no requirement for continued electrical power to hold the solenoid and the latching mechanism in a condition for lock opening.

18 Claims, 8 Drawing Sheets

SOLENOID CONTROLLED BOLT CONTROL FOR AN ELECTRONIC LOCK

CROSS REFERENCED TO RELATED APPLICATIONS

Co-pending patent application Ser. No. 08/852,854 entitled ELECTRONIC COMBINATION LOCK AND CAPACITOR CHARGING CIRCUIT THEREFORE, (Docket MH9-97-001) by James D. Hill, filed May 7, 1997, is a related application.

FIELD OF THE INVENTION

This invention relates to electronic combination locks and more specifically to electronic combination locks having low-level power sources or reserves and a relatively large power consumer, such as a solenoid, to control the unlocking of the bolt.

BACKGROUND OF THE INVENTION

Electronic combination locks have been known for many years. Recently, self-powered electronic combination locks have become well-known throughout the security industry in the form of the X-07 Electronic Combination Lock, the Cencon Lock and the Auditcon Lock, all sold by Mas-Hamilton Group of Lexington, Ky. All of these locks are self-powered electronic combination locks having a generator contained within the lock and manually operated by the operator at the time of lock opening in order to provide power to the electronic controls of the lock. The use of the manually powered mechanical drive to rotate a portion of the stepper motor which functions as a generator to produce the necessary power for the electrical operation of the lock eliminates the need for electrical power supply wiring from outside the lock or the use of a battery and the concomitant problems associated with batteries, such as aging, discharge and/or corrosion.

The stepper motor/generator of the electronic combination locks are capable of producing open circuit voltages well in excess of approximately sixteen volts during manual rotation, sufficient to charge capacitors to a level adequate to power the lock.

Due to size and space constraints within an electronic lock, the capacitor typically used with the X-07, Cencon and Auditcon Locks lacks the storage capacity to power the electronic control and provide the electrical current and power to operate a solenoid which may be used to control the mechanical chain of parts to drive the bolt from the extended position to a retracted, unlocked position.

Without an external or battery power source, a typical solenoid consumes too much power to pick and hold for the device to be practical in very low-level powered devices. The relatively large power consumption of a solenoid has dictated that electronic locks use either an alternative low-power consumption device such as a pulsed stepper motor, which has stable states as in the above Mas-Hamilton locks, or a battery or utility power supply connection in order to provide adequate power for a solenoid controlled device. The power source must maintain sufficient electrical power to operate the electrical controls of the lock pick and hold the solenoid or other device such as the stepper motor until the lock is unlocked and the bolt control activated to permit the retraction of the bolt.

Examples of solenoid controlled locks include U.S. Pat. No. 5,307,656 issued to Gartner, et.al. and U.S. Pat. No. 4,831,851 issued to Wayne F. Larson. The Gartner, et.al. lock is not disclosed as self-powered and, accordingly, a power supply such as a utility power source or a battery typically would be required to ensure operation of the lock, and the Larson lock is battery powered.

Solenoids have a characteristic of magnetically sealing the armature in an actuated position as a result of the coercitivity of the solenoid core and the residual magnetism in the body of the solenoid. This magnetic sealing and holding is normally addressed as an undesirable characteristic by the inclusion of a non-magnetic spacer between the solenoid body and the armature plate of the solenoid. The non-magnetic spacer prevents the armature plate from being pulled close enough to the solenoid body to be retained by the residual magnetic field of the core and solenoid.

If the spacer is removed and the sealing of the armature to the solenoid body permitted, the pulse solenoid will pick and hold until the magnetic seal is released by physical force exerted on the solenoid armature.

This magnetic sealing may be advantageously used in the right circumstances to permit the use of a much shorter and smaller pulse of energy by the solenoid in order to derive the desired mechanical displacement and mechanical action necessary to the operation of the lock.

OBJECTS OF THE INVENTION

It is an object of the invention to control the unlocking of a lock mechanism with a solenoid requiring only a minimal energy supply.

It is another object of the invention to relock the bolt withdrawal mechanism prior to the full restoration of the lock bolt to a locked, extended position.

It is a further object of the invention to restore the mechanical control elements of a lock to reset to a locked position prior to the restoration of the bolt lever to its locked position.

SUMMARY OF THE INVENTION

In the invention disclosed herein, the bolt lever is used to withdraw the bolt of an electronic combination lock. The bolt lever is controlled by a slide which, in turn, is locked from movement by a latch. The latch is activated for slide release by a solenoid pulsed with a very brief current flow controlled by an electronic signal from an electronic control such as a micro-processor. The solenoid pushes the latch lever out of blocking engagement with the slide, thereby releasing the slide for movement under the influence of a spring connected to the bolt lever and thus acting indirectly on the slide. The bolt lever and the slide are interconnected or engaged with each other such that movement of the bolt lever will displace the slide whenever released by a solenoid and a latch, thereby permitting the bolt lever to effect withdrawal of the bolt whenever the bolt lever is moved by a mechanical retraction device in the lock.

The spring force on the bolt lever provides the displacing force to move the slide as well as the bolt lever from a position corresponding to a locked position for the lock to a displaced position corresponding to an unlocked condition for the lock.

The solenoid armature plate seals to the body of the solenoid in its activated or picked condition due to the residual magnetism in the solenoid. The armature remains in the sealed condition until such time as the magnetic seal is broken by a mechanical force displacing the armature and armature plate relative to the solenoid body. The seal is broken by the armature plate being physically displaced to a position distanced from the solenoid body that the residual magnetic attractive force of the residual magnetic field is insufficient to hold the plate of the armature and, therefore, the spring connected to the latch lever is effective to return the solenoid armature to the unactuated or unpicked position. The mechanical force required to break the magnetic seal typically is relatively small (in the order of a few grams) for smaller solenoids.

The mechanical force to break the magnetic seal is derived from movement of a slide containing the bolt lever. After power removal, the solenoid remains in its actuated condition until the solenoid armature is unsealed from the solenoid body by the slide being displaced at least a distance sufficient to ensure that the unlocking operation of the lock will occur. Whenever the solenoid armature is unsealed from the solenoid body, the latch that normally blocks movement of the slide is allowed to partially restore to an intermediate position and then to fully restore upon the restoration of the slide to its fully restored position. This eliminates the possibility that the slide is not reset and latched at or before the restoration of the bolt lever and bolt to an extended locked position.

Once the slide is fully restored and latched, the path of movement for the bolt lever and particularly a tenon thereon may be blocked by a portion of the slide primarily intended to prevent the bolt lever from being moved to a position permitting the opening of the bolt. In so doing, the slide structure creates a condition which could prevent the locking of the lock. This problem is addressed by forming the slide to incorporate a serpentine beam spring that deflects to permit the passage of the tenon of the bolt lever. The serpentine beam spring and the slide cooperate to form a latch to prevent movement of the bolt lever under forced conditions while yet permitting restoration of the slide prior to the restoration of the bolt lever.

A more complete understanding of the invention may be acquired by referring to the drawings attached hereto and to the detailed description of the preferred embodiment of the best mode for implementing the invention the description of which follows.

DRAWINGS

DETAILED DESCRIPTION OF THE PREFERRED EMBODIMENT OF THE BEST MODE FOR CARRYING OUT THE INVENTION

Figure 1:
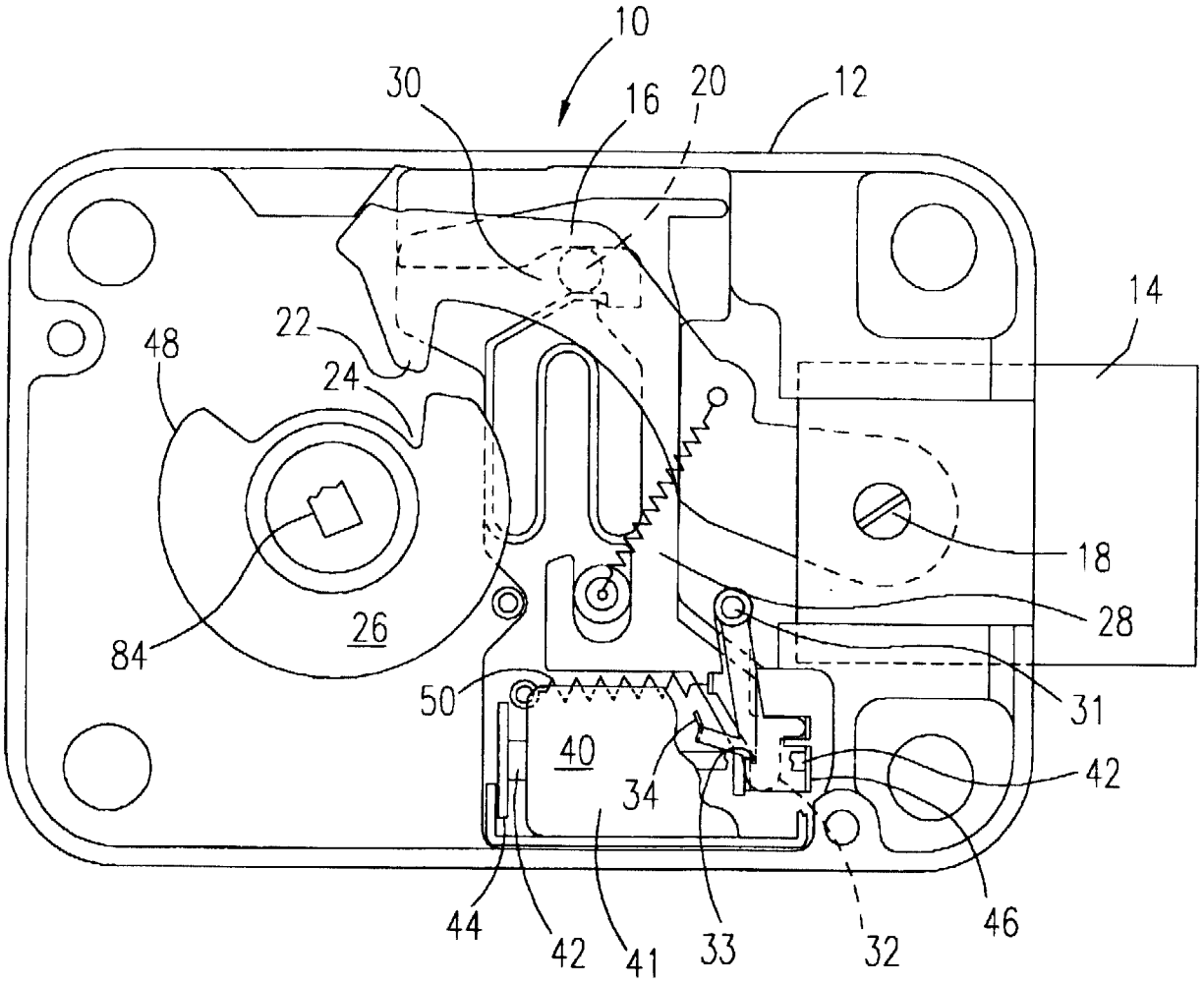
FIG. 1 is an illustration of the bolt control mechanism of the lock in a locked condition with the bolt extended.

Referring initially to FIG. 1, a lock embodying the invention is illustrated in its locked and unactivated condition. Lock 10 is contained within lock housing 12 which, in turn, supports lock bolt 14 for reciprocal movement between an extended and withdrawn position. The force necessary to displace lock bolt 14 from one of its positions to another of its positions is provided to lock bolt 14 by bolt lever 16, which is pivotally connected to lock bolt 14 at pivot connection 18. Pivot connection 18 preferably is a bolt screwed into bolt lever 16 through lock bolt 14. Further, bolt lever 16 has a tenon 20 protruding from one surface thereof, the back surface as illustrated in FIG. 1.

Bolt lever 16 is further provided with a conventional nose portion 22 which may be displaced about pivot connection 18 to engage a cam slot 24 in cam wheel 26.

For the bolt 14 to be withdrawn, it is necessary for the bolt lever 16 to be pivoted in a counter-clockwise direction around pivot connection 18 to engage nose portion 22 into cam slot 24 and then rotate cam 26 in a counter-clockwise direction. In order to initiate such a chain of events, the bolt lever 16 must be moved counter-clockwise about its pivot connection 18.

Slide 28 is formed defining a slot 30 therein. Slot 30 is the residence for tenon 20 and any movement of slide 28 will cause a corresponding movement of tenon 20 and bolt lever 16 along with slide 28.

Figure 2:
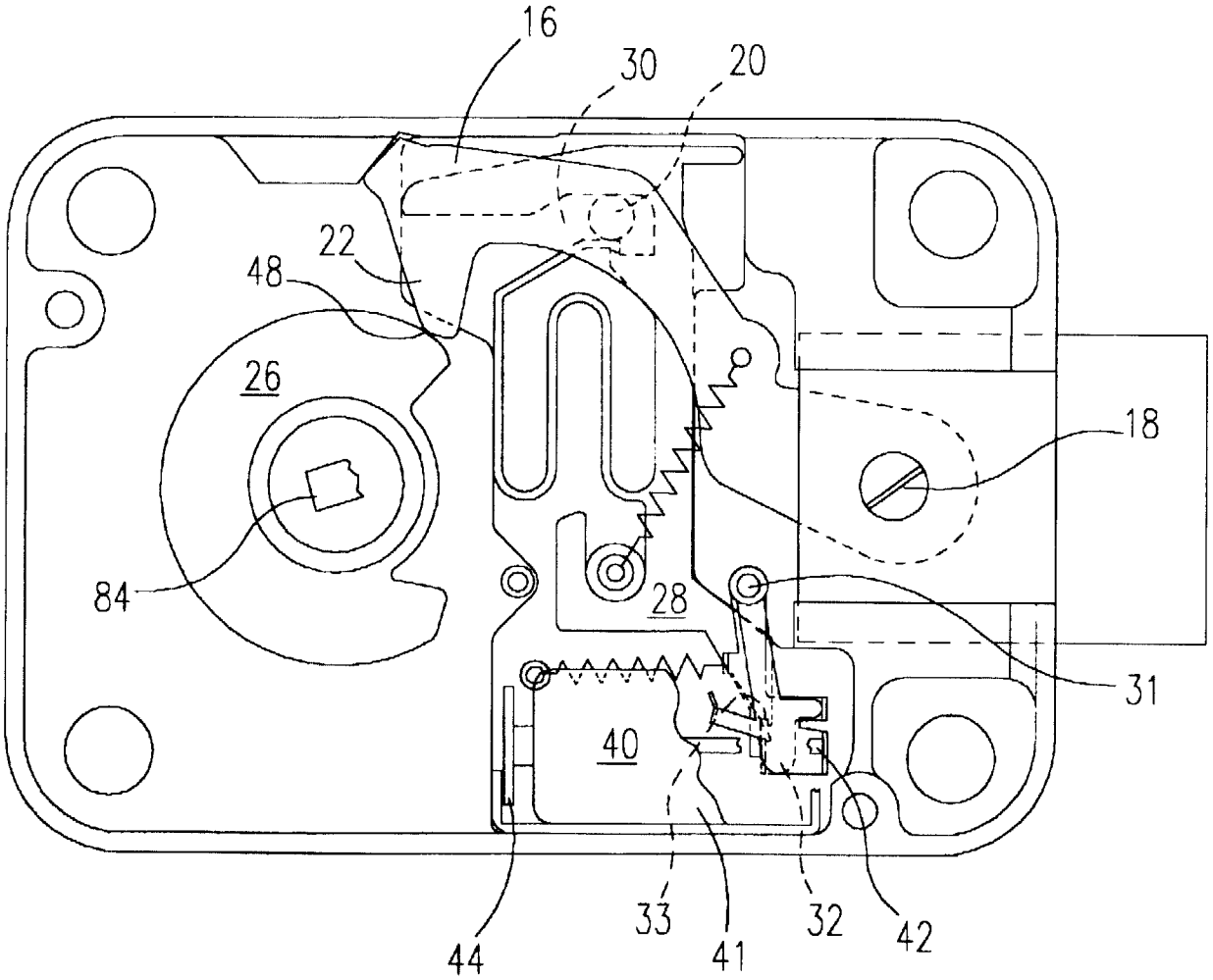
FIG. 2 is an illustration of the bolt control mechanism of the lock with the slide of the bolt control mechanism latched and the bolt extended.
Figure 3:
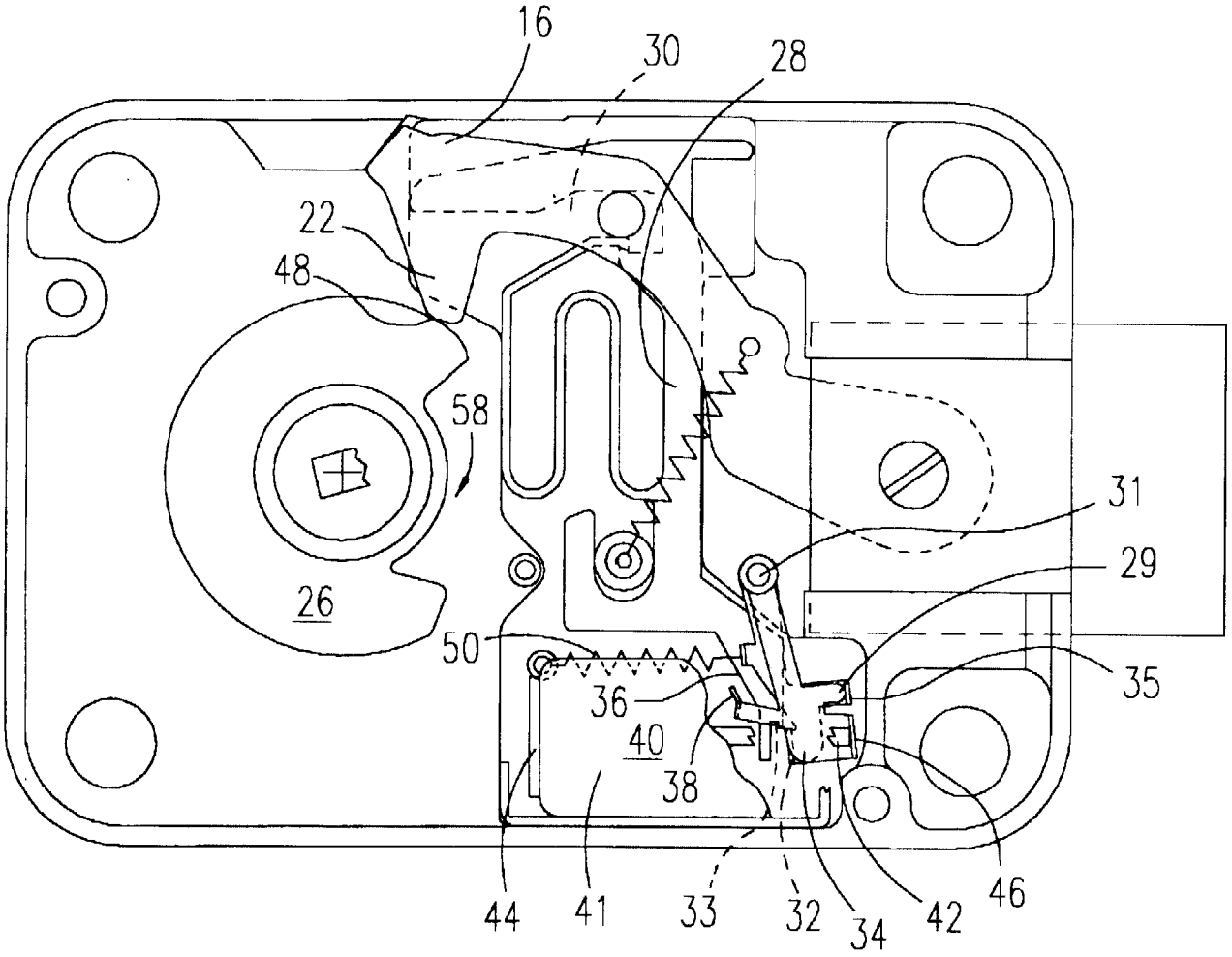
FIG. 3 is an illustration of the bolt control mechanism of the lock with the slide of the bolt control mechanism raised and unlatched and the solenoid actuated to perform the unlatching operation.

In order to engage nose piece 22 into cam slot 24, slide 28 must move downward as viewed in FIGS. 1–3. The downward movement of slide 28 is blocked by latch 32 engaging latch notch 33 of slide 28. Latch 32 is pivoted at latch pivot 31 to the lock housing 12.

Commonly pivoted at latch pivot 31 is a solenoid reset lever 34. Solenoid reset lever 34 is operative to restore the solenoid armature 42 from its sealed to its unsealed condition, as will be explained more fully later.

Solenoid 40 is mounted within the lock housing 12. Solenoid 40 is a conventional push solenoid with its armature 42 disposed coaxially with solenoid 40. The armature plate 44 is a part of or attached to armature 42 which extends entirely through the length of the solenoid 40. In operation, armature 42 will extend from the right end of the solenoid 40; the extension of the armature 42 is accomplished by the magnetic attraction of armature 42 and armature plate 44 toward the solenoid 40. Energization of the solenoid 40 with a very short pulse will create a sufficient flux field to attract the armature plate 44 and armature 42 toward the solenoid 40 thereby extending armature 42 from the opposite end of the solenoid housing 41 and extending tension spring 50. As the solenoid armature 42 is pulled, toward the right in FIG. 3, by the magnetic field of solenoid 40 the armature 42 will engage the latch input tab 46, which receives the solenoid 40 input. Assuming it is free to move, the latch input tab 46 will pivot counter-clockwise around latch pivot 31, moving the latch 32 out of engagement with latch notch 33 in slide 28 through engagement of tab 29 against latch tab 35.

In order for the latch 32 to be pivotable about latch pivot 31, slide 28 must be moved upwardly, as shown in FIGS. 2 and 3. FIG. 2 illustrates slide 28 in its raised position as a result of the engagement of nose portion 22 with the high dwell 48 on cam 26. With the high dwell 48 engaged by the nose portion 22 of bolt lever 16, bolt lever 16 will be displaced clockwise about pivot connection 18 and tenon 20 will act against the upper surface of slide slot 30, thus displacing slide 28 in an upward direction. In so doing, notch 33 will be disengaged from latch 32 and latch 32 will be freed for movement.

With the slide 28 raised, as illustrated in FIG. 2, latch 32 is freed for pivoting counter-clockwise around latch pivot 31. Solenoid 40 is energized and armature 42 is extended from the right end of the solenoid 40 to pivot latch 32.

The condition whereby the cam 26 engages the bolt lever 16 with nose portion 22 on the high dwell 48 of cam 26 also is illustrated in FIG. 3. The condition whereby the solenoid 40 has been pulsed and the armature plate 44 has been attracted to the solenoid body 40, thereby extending the armature 42, is best viewed in FIG. 3. In all other regards the positions of the slide 28, bolt lever 16, nose portion 22 and cam 26 are all the same in FIG. 3 as in FIG. 2.

Latch 32 is shown in FIG. 3 in its disengaged or unlatched position as a result of extension of armature 42 against a latch input tab 46. The engaging portion of latch 32 is disengaged from latch notch 33, freeing slide 28 for movement in a direction generally downward as illustrated in FIG. 3. The high dwell 48 of cam 26 continues to hold the bolt lever 16 and slide 28 in their raised positions. Solenoid armature plate 44 is magnetically sealed against solenoid body 40 due to the residual magnetism within solenoid body 40. Thus, latch 32 will remain in its unlatched condition until such time as the solenoid reset lever 34 is pivoted about latch pivot 31 to cause a breaking of the magnetic seal between armature plate 44 and solenoid 40. The seal breaking action or resetting action is a result of the pivoting of the solenoid reset lever 34 about latch pivot 31. The solenoid reset lever 34 is spring biased by spring 50 in a clockwise direction about latch pivot 31. The force exerted by the spring 50 is less than the residual magnetic attraction force on armature plate 44 and, therefore, the spring 50 will not reset solenoid reset lever 34 whenever the armature plate 44 is magnetically sealed to the solenoid 40.

To improve resistance to physical shock and vibration, the latch notch 33 is formed with sides parallel to each other and parallel to latch 32 at that portion resident in latch notch 33 when latched.

Figures 4, 4A:
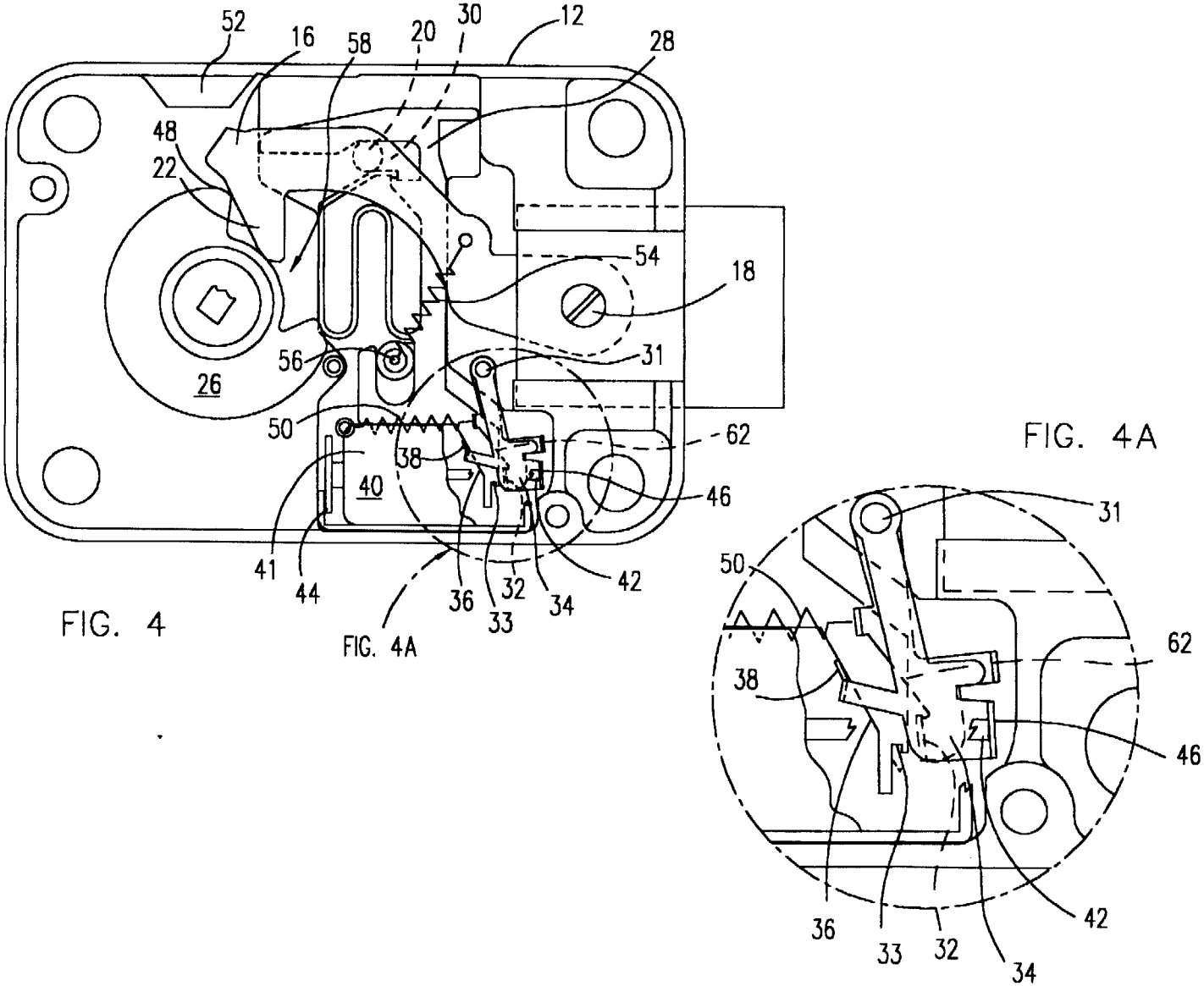
FIG. 4 is an illustration of the bolt control mechanism with the slide unlatched, the bolt lever in position to be pulled by the cam wheel and the bolt extended.
FIG. 4A is an enlarged illustration of the solenoid and slide latching mechanism shown in FIG. 4.

With the armature 42 magnetically held in the actuated position, the latch 32 will remain disengaged from the latch notch 33 and permit the displacement of slide 28 until such time as the armature plate 44 is reset and the armature 42 withdrawn into solenoid 40. The rotation of cam 26 in a counter-clockwise direction, in an effort to in the nose portion 22 of bolt in the nose portion 22 of bolt lever 16 dropping off of the high dwell 48 of cam 26 into window 58 and permitting the bolt lever 16 to pivot counter-clockwise about pivot connection 18. The pivoting motion of bolt lever 16 in a counter-clockwise direction will cause tenon 20 to act on the bottom surface of slide slot 30, thereby forcing slide 28 downwardly, as shown in FIG. 4. The movement of bolt lever 16 will cause the disengagement between the end thereof and lever boss 52 of lock housing 12. The motive power for moving of bolt lever 16 is provided by spring 54 connected between bolt lever 16 and a post 56.

Once the gate 58 in cam wheel 26 is disposed adjacent nose portion 22 of bolt lever 16, spring 54 will contract, pulling bolt lever 16 counter-clockwise, displacing slide 28 downward and engaging solenoid reset cam 36 with solenoid reset cam follower 38, a portion of the solenoid reset lever 34. As the slide 28 descends, as in FIG. 3, solenoid reset cam follower 38 will be forced in a clockwise direction together with the remainder of the solenoid reset lever 34 about latch pivot 31 by solenoid reset cam 36 on slide 28. As slide 28 progresses from its position in FIG. 3 to its position in FIG. 4, the latch input tab 46 is rotated counter-clockwise about latch pivot 31 and forces the armature 42, generally to the left as viewed in FIG. 4, displacing armature plate 44 to a distance sufficient that the residual magnetic attraction in solenoid 40 is ineffective to re-attract armature plate 44 to a sealed position against solenoid housing 41.

As solenoid reset lever 34 is rotated by the solenoid reset cam 36 acting on the solenoid reset cam follower 38, the force exerted by solenoid reset lever 34 against the latch 32 is relieved, hence permitting spring 50 to urge latch member 32 counter-clockwise around latch pivot 31 and further to engage latch 32 with side surface 62 of slide 28. Thus, latch 32 is positioned for re-engagement or latching engagement with the notch 33 upon the restoration of slide 28 to its raised or retracted position.

Figure 5:
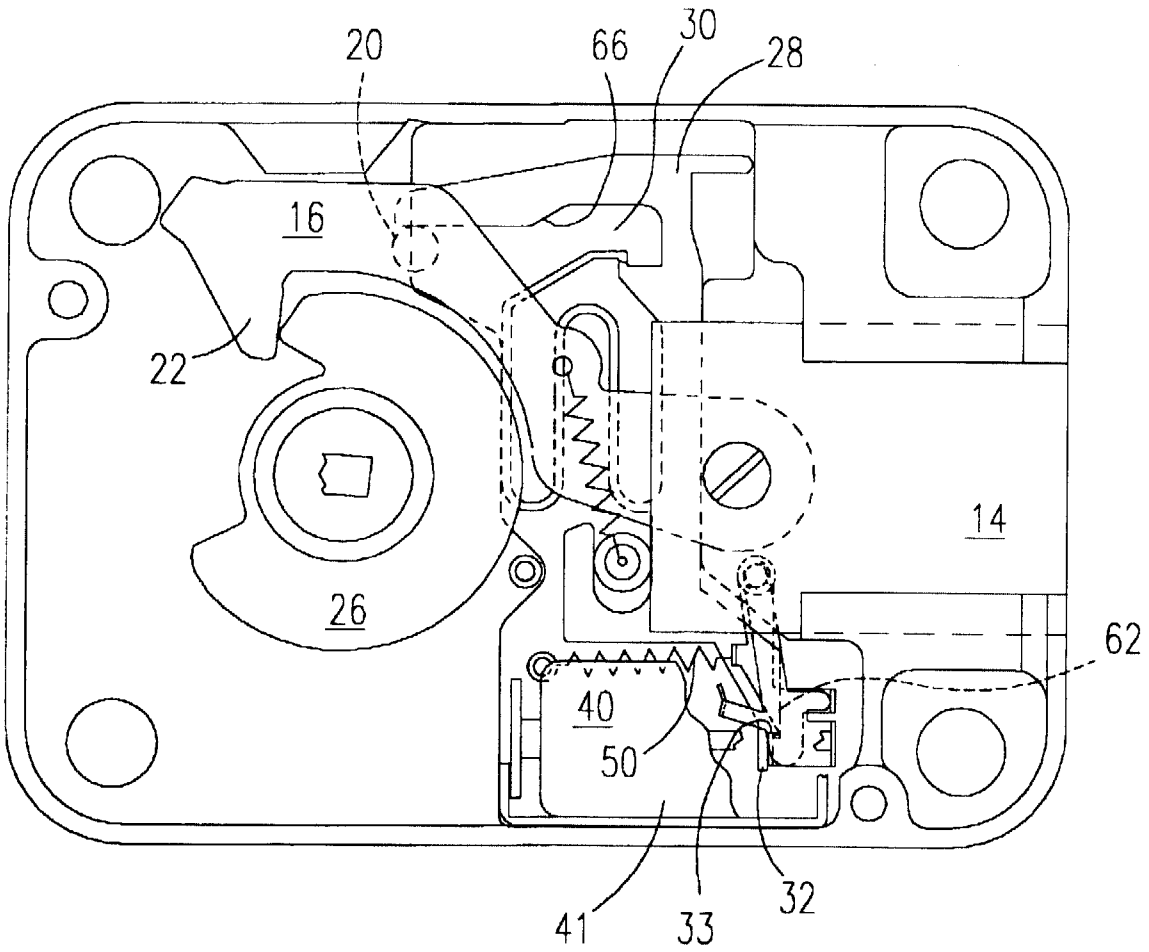
FIG. 5 is an illustration of the bolt control mechanism of the lock with the bolt lever fully withdrawn.

Referring now to FIG. 5, cam wheel 26 is illustrated as rotated counter-clockwise to the point where a portion thereof engages nose portion 22 of bolt lever 16. As illustrated, bolt lever 16 has been displaced generally leftward and, in so translating, has withdrawn bolt 14 to its unlocked position. In translating bolt lever 16 from right to left, tenon 20 engages cam surface 66 on slide 28. Cam surface 66 serves to raise or restore slide 28 to its raised position as a result of the movement of opening bolt lever 16 or withdrawing bolt 14. As slide 28 is raised to its restored position, latch 32 slips from the side surface 62 of slide 28 to be positioned in line with latch notch 33. Latch 32 is urged into the relocked or latched position by spring 50.

Figure 6:
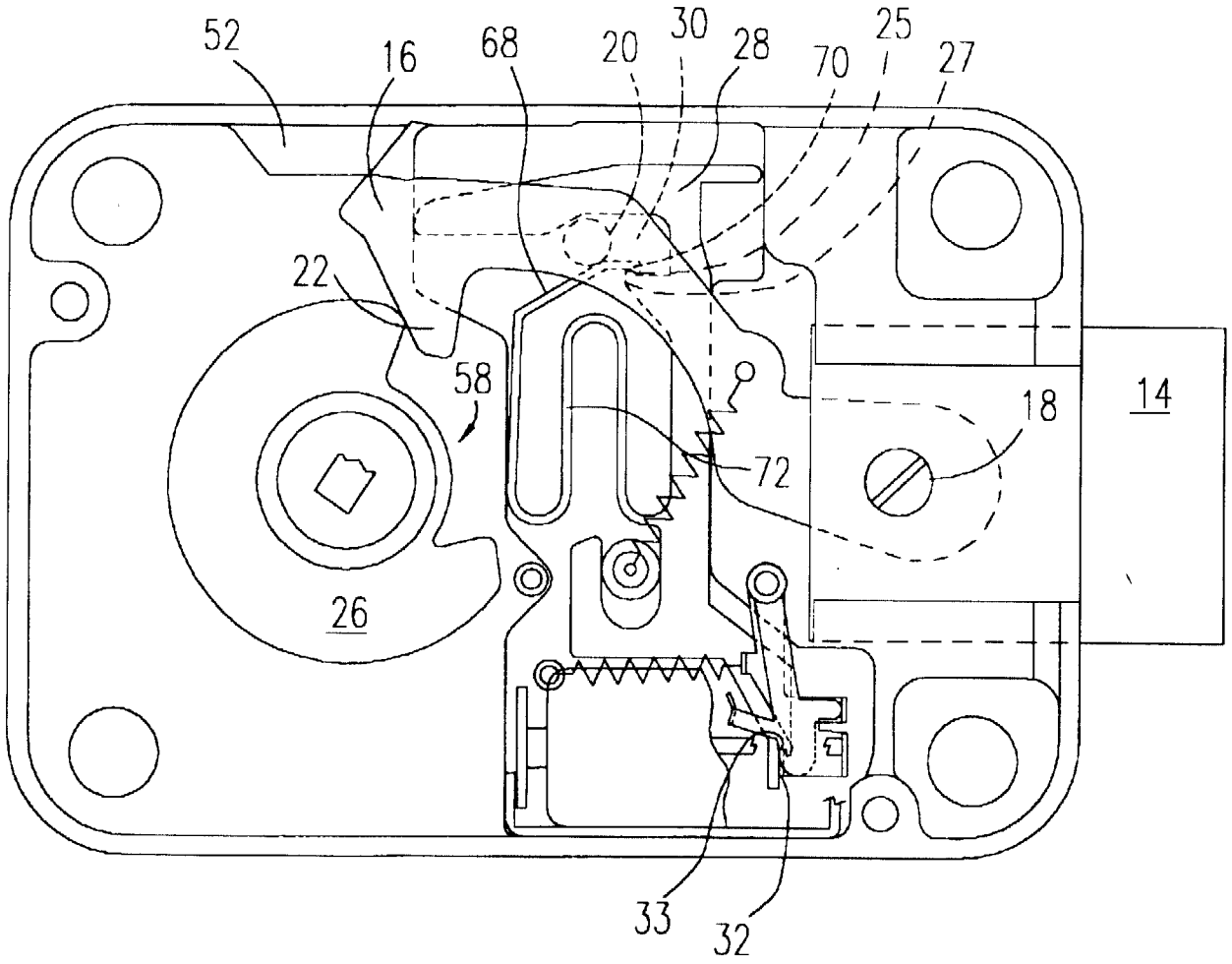
FIG. 6 is an illustration of the bolt control mechanism of the lock with the bolt fully and the bolt lever partially restored to a locked condition.

In reference to FIG. 6, cam 26, when rotated in a clockwise direction, will engage nose portion 22 of bolt lever 16 and will force bolt lever 16 upward against lever boss 52. Thereafter, the continued clockwise rotation of cam wheel 26 forces bolt lever 16 rightward with the top portion of bolt lever 16 riding against and following the underside of lever boss 52 until such time as the bolt lever 16 can clear lever boss 52. Having been placed in a position whereby latch 32 has been restored to its latching position engaged with latch notch 33, slide 28 is incapable of moving downward in response to engagement of tenon 20 with the sloped surface 68 of relock latch 70.

Relock latch 70 is a portion of a serpentine spring 72, which is supported by and extends from support 27. As serpentine spring 72 will deflect under the force exerted thereon by tenon 20, the serpentine spring 72 permits the passage of the tenon 20 into slot 30 in slide 28. Once serpentine spring 72 has been deflected sufficiently to the right to pass tenon 20 into slot 30, the exerted forces of the serpentine spring 72, and more specifically, the sloped surface 68 thereof together with the force exerted by the cam wheel 26 on nose portion 22 will tend to move the bolt lever 16 in a clockwise direction about its pivot connection 18. Once the end of bolt lever 16 clears lever boss 52, the combined forces of the cam wheel 26 and the sloped surface 68 acting on nose portion 22 and tenon 20, respectively, will force bolt lever 16 in a clockwise direction around its pivot connection 18, generally upward. Once tenon 20 has cleared the relock latch 70, the serpentine spring 72 will effect restoration to its undeflected position and thus will effectively block the movement of tenon 20 in a counter-clockwise direction about pivot connection 18 in response to any force exerted on lock bolt 14, in turn; then this force movement would force bolt lever 16 against lever boss 52. Without the relock latch 70 effectively blocking tenon 20, a force on bolt 14 could cause the bolt lever 16 to be cammed by lever boss 52 in a counter-clockwise direction about pivot connection 18. If the window 58 of cam wheel 26 was properly aligned with nose portion 22, the bolt lever 16 possibly could be forced downwardly, off of lever boss 52, permitting unauthorized opening of the lock 10 by the application of end bolt pressure.

Relock latch 70 and support 27 share an interface 25 oriented at an angle to relieve movement of relock latch 70 relative to support 27 in a restoring direction and to block movement of relock latch 70 in the opposite direction.

Figure 7:
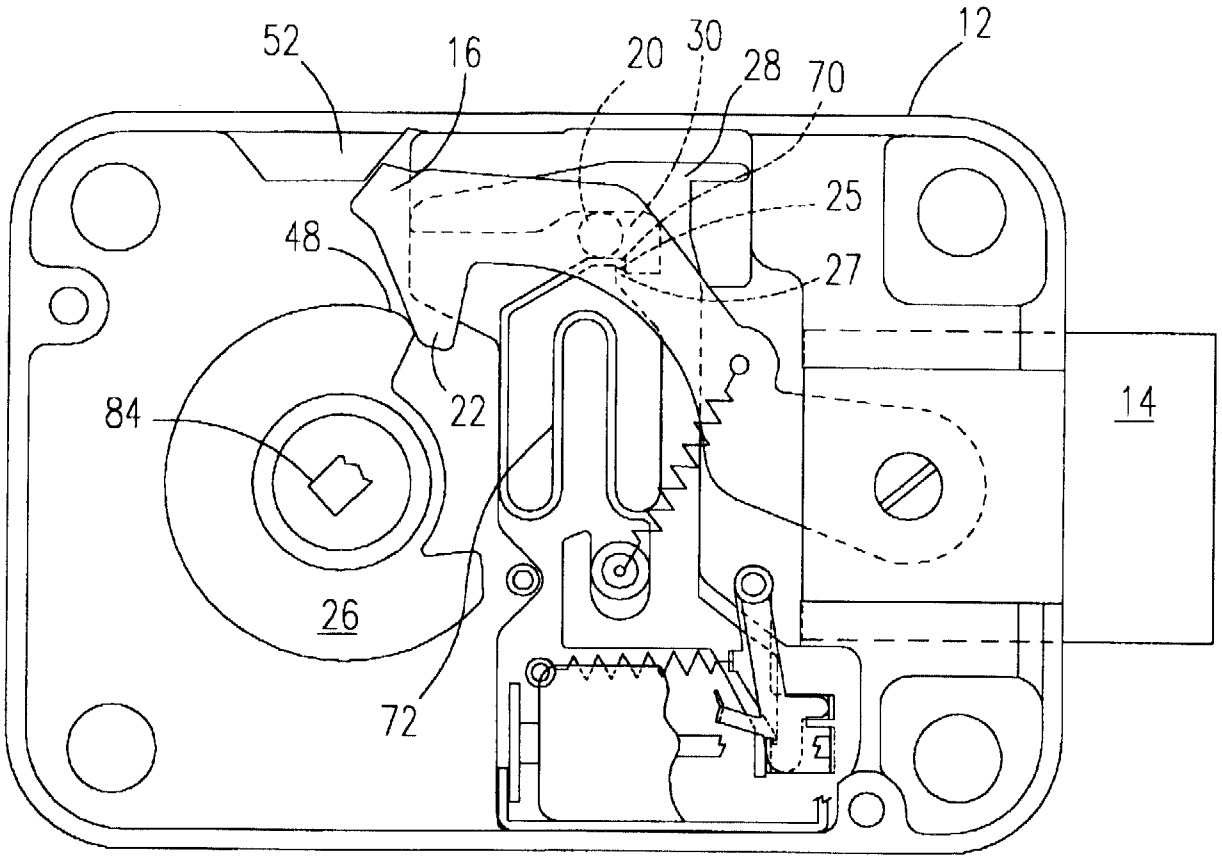
FIG. 7 is an illustration of the bolt control mechanism of the lock with the slide latched in the lock position, the bolt extended and the bolt lever being restored.

Referring now to FIG. 7, cam 26 is shown exerting further restore forces on nose portion 22 of bolt lever 16, effectively raising tenon 20 into the slot 30 of slide 28. The serpentine spring 72 has restored to its undeflected position thereby positioning relock latch 70 under tenon 20 and effectively blocking any downward or leftward movement of tenon 20 which would be necessary for bolt lever 16 to clear lever boss 52 of lock casing 12.

Figure 8:
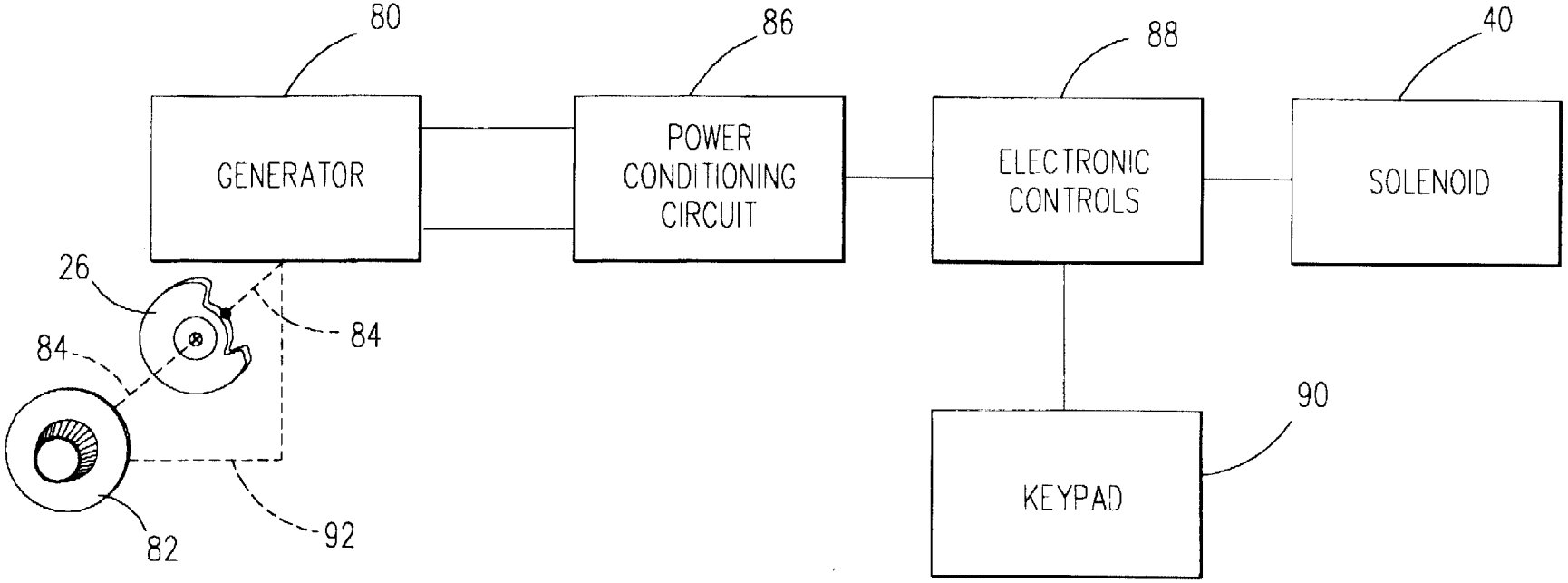
FIG. 8 is a block diagram of the electronic controls that control the solenoid of the lock in FIGS. 1–7.

Referring now to FIG. 8, there is shown therein a schematic diagram of the electronic portions of the lock 10. Generator 80 is operated by dial 82 which is connected by a shaft 84, connecting generator 80 and cam wheel 26. Rotation of dial 82 operates the generator 80 to provide an output of generated electrical power to power conditioning circuits 86. Power conditioning circuits 86, in turn, provide power in the form of a DC voltage to the electronic controls 88. Alternatively, only the dial 82 and cam wheel 26 may be interconnected and there may be a separate drive path 92 between dial 82 and generator 80.

The electronic controls 88 can receive a combination from an operator through keypad 90 or other input means, such as magnet cards, electronic keys or dial input, and subsequently the electronic controls 88 compare the combination with an authorized combination. In the event that the entered combination and the authorized combination compare equal, the electronic controls 88 then output a signal to operate the solenoid 40.

For the operation of the solenoid to be effective, it should be understood that the solenoid 40 must be pulsed at a time when the bolt lever 16, engaged with the high dwell 48 of cam wheel 26, is in its raised position. This is necessary in order to relieve the loading of slide 28 on latch 32 and relieve the forces on latch 32. If the lock 10 is to operate so that the position of the high dwell 48 can be other than engaged with nose position 22 at the time the lock 10 is ready to be opened, an electrical timing circuit is necessary to cause the energization of solenoid 40 whenever the slide 28 is raised or retracted to free latch 32.

It should become apparent from the foregoing description and drawings that this invention provides several advantages over prior solenoid operated electronically controlled locks. The most significant of the advantages is that operation of the solenoid 40 requires only a very short pulse of current provided from a capacitor to pick the solenoid 40 once the combination is properly entered into the lock 10. A second advantageous feature of this device is that the solenoid 40 will remain in its actuated condition, thus eliminating the need for continued current flow to the solenoid 40 during the period of time necessary to physically open the lock 10 and withdraw the bolt 14.

These two aspects of the system permit the storing of limited quantities of electrical energy in capacitors in a self-powered lock for operational control wherein the lock has no continuing power supply available from either a battery or a utility service connection.

A further advantage of this system is that the slide mechanism restores to its latched position very early in the lock cycle and ensures that once the bolt lever 16 is restored to its locked position, neither can it be dislodged nor the bolt 14 reopened by forcing the bolt 14 itself.

While the invention has been described with respect to particular parts and elements of the lock, one will appreciate that minor modification and substitutions of similar and equivalent parts may be made without the removal of the resulting lock from the protection provided by the scope of the appended claims.

We claim:

1. A lock bolt control for use in an electronic lock comprising:

a lock bolt;

a bolt lever connected to said lock bolt;

a cam having a cam slot disposed for rotation effective to withdraw said lock bolt whenever said bolt lever is engaged with said cam slot;

said bolt lever displaceable from a position of disengagement with said cam to a position of engagement with said cam;

a slide drivingly engaged with said bolt lever;

said slide latchable in a position corresponding to said bolt position being extended and locked;

a latch disposed to engage and block movement of said slide and moveable to a disposition removing an impediment to movement of said slide;

said latch moveable in relation to said cam rotation;

a solenoid having an armature extendible upon energization; said armature engageable with said latch to dispose said latch in an ineffective disposition; and said cam comprising a surface to displace said lock lever in a direction urging said slide to a position that said latch may be disengaged from said slide.

2. The lock bolt control of claim 1 wherein said latch is a two-part latch wherein a first part of said latch is spring-biased toward a position engaging said slide, thereby blocking movement of said slide in one direction.

3. The lock bolt control of claim 2 wherein a second part of said latch is commonly pivoted with said first part of said latch and engageable by said solenoid armature to displace said first part of said latch out of engagement with said slide.

4. The lock bolt control of claim 3 wherein said second part of said latch is engageable with and derives a restoring movement from said slide moving from a position corresponding to a locked condition to a position corresponding to an unlocked position.

5. The lock bolt control of claim 4 wherein said restoring movement of said second part of said latch breaks a residual magnetic attraction between said solenoid and said solenoid armature and forces said armature to a restored position.

6. The lock bolt control of claim 5 wherein said second part of said latch is spring-biased toward a blocking position relative to said slide.

7. The lock bolt control of claim 2 further comprising a lever boss disposed in a blocking relation to said bolt lever whenever said bolt lever is in said position of disengagement and said slide further comprises an integral spring structure deflectable by said bolt lever to permit passage of said bolt lever past said lever boss whenever said slide is in a latched position.

8. The lock bolt control of claim 7 wherein said integral spring of said slide is a serpentine beam spring.

9. A lock bolt control for use in an electronic lock comprising:

a lock bolt;

a bolt withdrawal mechanism operative to withdraw said lock bolt;

a latch disposed to engage and block operation of said bolt withdrawal mechanism and moveable to a disposition removing an impediment to operation of said bolt withdrawal mechanism;

said latch moveable responsive to said bolt withdrawal mechanism operation;

a solenoid having an armature displaceable upon energization, said armature engageable with said latch upon displacement to dispose said latch in an ineffective disposition; and said bolt withdrawal mechanism comprising a displaceable cam engageable with said latch and operative to restore said solenoid during operation of said bolt withdrawal mechanism.

10. The lock bolt control of claim 9 wherein said bolt withdrawal mechanism comprises a slide having a cam integral therewith and said latch is a two-part latch wherein a first part of said latch is spring-biased toward a position engaging said slide, thereby blocking movement of said slide in one direction and thereby preventing operation of said bolt withdrawal mechanism.

11. The lock bolt control of claim 10 wherein a second part of said latch is commonly pivoted with said first part of said latch and engageable by said solenoid armature to displace said first part of said latch out of engagement with said slide.

12. The lock bolt control of claim 11 wherein said second part of said latch is engageable with and derives a restoring movement from said displaceable cam moving from a position corresponding to a locked condition to a position corresponding to an unlocked position.

13. The lock bolt control of claim 12 wherein said restoring movement of said second part of said latch breaks a residual magnetic attraction between said solenoid and said solenoid armature and forces said armature to a restored position.

14. The lock bolt control of claim 13 wherein said second part of said latch is spring-biased toward a blocking position relative to said slide.

15. The lock bolt control of claim 10 wherein said bolt withdrawal mechanism further comprises a bolt lever and said lock further comprises a lever boss disposed in a blocking relation to said bolt lever whenever said bolt lever is in said position of disengagement and said slide further comprises an integral spring structure deflectable by said bolt lever to permit passage of said bolt lever past said lever boss whenever said slide is in a latched position.

16. The lock bolt control of claim 15 wherein said integral spring of said slide is a serpentine beam spring.

17. An electronic lock comprising:

a bolt control for controlling the withdrawal and extension of a bolt, comprising;

a bolt lever pivoted to said bolt and comprising a rigid pin;

a slide displaceable to directly displace said bolt lever;

said slide comprising an integral spring member, said integral spring member directly engaging said bolt lever pin; and said spring member deflectable in a first direction to pass said bolt lever pin in a first direction and rigid in a second direction to prevent said bolt lever pin from passing said spring member in a second direction.

18. The electronic lock of claim 17 whereby said spring of said spring of said slide is operative to trap said bolt lever in a locked position when said slide is in a position corresponding to a locked condition.

* * * * *